US009989236B2

(12) United States Patent
Sommerschuh

(10) Patent No.: US 9,989,236 B2
(45) Date of Patent: Jun. 5, 2018

(54) LIGHTING MODULE COMPRISING A DIODE

(71) Applicant: Valeo Vision, Bobigny (FR)

(72) Inventor: Stephan Sommerschuh, Paris (FR)

(73) Assignee: VALEO VISION, Bobigny (FR)

( * ) Notice: Subject to any disclaimer, the term of this patent is extended or adjusted under 35 U.S.C. 154(b) by 26 days.

(21) Appl. No.: 14/883,778

(22) Filed: Oct. 15, 2015

(65) Prior Publication Data

US 2016/0109108 A1 Apr. 21, 2016

(30) Foreign Application Priority Data

Oct. 16, 2014 (FR) ..... 14 59962

(51) Int. Cl.

| | |
|---|---|
| ***F21V 7/04*** | (2006.01) |
| ***F21V 29/70*** | (2015.01) |
| ***F21S 8/10*** | (2006.01) |
| ***F21V 29/503*** | (2015.01) |
| *F21Y 115/10* | (2016.01) |

(52) U.S. Cl.

CPC ..... *F21V 29/70* (2015.01); *F21S 48/1104* (2013.01); *F21S 48/115* (2013.01); *F21S 48/1109* (2013.01); *F21S 48/321* (2013.01); *F21S 48/328* (2013.01); *F21V 29/503* (2015.01); *F21Y 2115/10* (2016.08)

(58) Field of Classification Search

CPC ..... H01L 23/3677

See application file for complete search history.

(56) References Cited

U.S. PATENT DOCUMENTS

| | | | | |
|---|---|---|---|---|
| 8,439,537 | B2 | 5/2013 | Nakazato et al. | |
| 9,618,188 | B2 | 4/2017 | Hatanaka et al. | |
| 2008/0253127 | A1* | 10/2008 | Willwohl | F21K 9/00 362/294 |
| 2009/0034283 | A1* | 2/2009 | Albright | F21S 48/215 362/545 |
| 2009/0296416 | A1* | 12/2009 | Luo | F21K 9/00 362/487 |
| 2009/0296418 | A1* | 12/2009 | Luo | F21K 9/00 362/516 |
| 2010/0008095 | A1* | 1/2010 | Tsukamoto | F21V 19/00 362/382 |

(Continued)

FOREIGN PATENT DOCUMENTS

| | | | |
|---|---|---|---|
| DE | 202014002809 | U1 | 4/2014 |
| DE | 202014000778 | U1 | 5/2014 |

(Continued)

*Primary Examiner* — Alexander Garlen

(74) *Attorney, Agent, or Firm* — Oblon, McClelland, Maier & Neustadt, L.L.P.

(57) ABSTRACT

A lighting module, in particular for illumination and/or signaling, comprising a heatsink on which is mounted a light emitting diode comprising a central axis (xx'), the heatsink comprising a body of which a front face is maintained in abutment against a rear face of the diode, the body comprising at least one orifice passing through the body and opening out on its front face through which pass one or more connection pins extending from the rear face of the diode. The central axis (xx') of the diode does not pass via an orifice passing through the body and through which a connection pin extends.

20 Claims, 3 Drawing Sheets

(56) References Cited

U.S. PATENT DOCUMENTS

| | | | | |
|---|---|---|---|---|
| 2010/0128479 | A1* | 5/2010 | Biebl | F21K 9/00 362/249.02 |
| 2012/0063157 | A1 | 3/2012 | Nakazato et al. | |
| 2014/0029282 | A1 | 1/2014 | Ravier et al. | |
| 2014/0340653 | A1 | 11/2014 | Chifu et al. | |
| 2015/0285470 | A1 | 10/2015 | Hatanaka et al. | |

FOREIGN PATENT DOCUMENTS

| | | | |
|---|---|---|---|
| EP | 2063170 | A2 | 5/2009 |
| EP | 2690352 | A1 | 1/2014 |
| JP | 2014107229 | A | 6/2014 |
| WO | 2013042193 | A1 | 3/2013 |

* cited by examiner

LIGHTING MODULE COMPRISING A DIODE

CROSS-REFERENCE TO RELATED APPLICATIONS

This application claims priority to the French application 1459962 filed on Oct. 16, 2014, which application is incorporated herein by reference and made a part hereof.

BACKGROUND OF THE INVENTION

1. Field of the Invention

The invention relates to the field of light emitting diodes, and preferably high-power laser diodes, designed to equip, for example, illumination systems mounted on motor vehicles. These diodes make it possible to produce beams of which the form and distribution of light can be modulated as required.

2. Description of the Related Art

Such devices are described, by way of example, in publication EP 2 063 170 and publication EP 2 690 352. However, these diodes have to be associated with an effective cooling device owing to the large amounts of heat they produce.

To that end, it has been proposed to mount the diodes on supports acting as radiators, allowing the diode to be assembled into the illumination system.

To optimize the orientation of the light beam emitted by the diode, the optical device in which the diode is mounted has to be adjusted in advance and the angular position of the diode about its central axis, passing substantially through the center of the part of the light-emitting diode, has to be precisely positioned so as to optimize the light yield of the device.

The diode is then turned about the central axis until this optimal position is achieved.

The connection or joining pins used to power and to control the diode are arranged, generally speaking, on the rear part of the diode, and pass through the support in order to be connected to the external electric connection members.

These connection pins are placed around the rear central part of the diode and are located on a circle of which the center is arranged substantially on the central axis of the diode. In the most frequent case, in which the diode comprises only two pins, the two pins are located on a circle of which the diameter corresponds to the segment connecting the two pins and of which the center is located on the central axis of the diode.

Generally speaking, the support on which the diode is arranged comprises a single substantially circular orifice through which the connection pins extend. The diode is then positioned in such a manner that its central axis is one and the same as the axis of the orifice. Furthermore, the diameter of the orifice is adjusted in order to allow the passage of the joining pins. The central axis of the diode then passes through the orifice into which the pins extend.

It has been observed, however, that the hottest spot of the diode is precisely in a central part located about the central axis of the diode. This arrangement thus means that the contact between the rear part of the diode located about the central axis and corresponding to this hot spot and the cooling means is therefore lost at the orifice through which the connection pins pass. This arrangement gives rise to a reduction in the capacity of the radiator to evacuate the heat generated by the diode, which increases the risk of damage to the diode from the excess heat produced.

Aware of this central hot-spot phenomenon, laser diode manufacturers have proposed placing the connection pins off center relative to the central axis of the diode so as to allow better contact between the cooling system and the rear central part where this hot spot is located. The connection pins are thus no longer arranged on a circle of which the center is placed on the central axis of the diode. Furthermore, when the diode comprises only two pins, the central axis of the diode no longer passes through the middle of the segment connecting the two pins or through this segment itself.

The use of this type of diode requires the diameter of the orifice through which the connection pins pass to be further enlarged in order to allow the rotation of the diode about its central axis. Moreover, the advantages arising from this new arrangement are lost insofar as, because the orifice is of larger diameter, the central part of the diode is even less able than before to evacuate the heat generated by the diode.

SUMMARY OF THE INVENTION

The object of the invention is to propose a lighting module, in particular for illumination and/or signaling, comprising a heatsink on which is mounted a light emitting diode comprising a central axis, the heatsink comprising a body of which a front face is maintained in abutment against a rear face of the diode, the body comprising at least one orifice passing through the body and opening out on its front face through which pass one or more connection pins extending from the rear face of the diode. Preferably, the orifice is of circular or oblong form.

This lighting module is characterized in that the central axis of the diode does not pass via an orifice passing through the body and through which a connection pin extends.

Thus, the contact between the rear face of the diode located about the central axis and corresponding to the hot spot of the diode and the front face of the heatsink is re-established.

By arranging the connection pins and the orifices appropriately, this mounting thus makes it possible to establish a permanent contact between the hot spot of the diode and the heatsink and to benefit from the advantages achieved by the diodes now proposed by manufacturers.

The lighting module according to the invention may also comprise, in isolation or in combination, the following features:

- the rear face of the diode comprises an imaginary disk, or an area of a surface of the light emitting diode, centered on the central axis, which is in contact with the front face of the body of the heatsink.
- the body of the heatsink is mounted in a casing such that the angular position of the body of the heatsink relative to the casing can be adjusted in rotation about an axis substantially perpendicular to the front face of the body of the body of the heatsink.
- the casing and the heatsink are of complementary form.
- the axis of rotation of the heatsink in the casing and the central axis of the diode are one and the same.
- the axis of rotation of the heatsink does not pass via an orifice formed in the body of the heatsink.
- the body of the heatsink comprises as many orifices, each designed to receive a pin, as there are pins extending from the rear face of the diode.
- the body of the heatsink and the diode comprise means for blocking the rotation of the diode about its central axis relative to the body of the heatsink.

the means for blocking the rotation of the diode are formed by studs arranged on the front face of the body of the heatsink collaborating with notches formed on the lateral edges of the diode.

the lighting module further comprises a closure element abutting on a front part of the laser diode in order to maintain the diode in abutment on the front face of the body of the heatsink.

the closure element and the casing are mechanically linked to one another in such a manner as to prevent the exit of the heatsink from the casing.

the closure element and the casing are mechanically linked to one another by a link of screw/nut type or by clip or snap-fit means.

the heatsink comprises exchange means forming a heat sink extending through a window arranged in an end wall of the casing.

the heatsink comprises means for the circulation of a cooling fluid.

the heatsink comprises means for the circulation of air.

the heatsink comprises a thermoelectric cooling system.

the light emitting diode is a high-power laser diode.

The invention also relates to a light device, in particular for illumination and/or signaling for a motor vehicle, comprising a lighting module according to one or other of the preceding features and which is fastened to a chassis of the light device by means of the casing. The closure element may usefully be formed by a boss forming part of the chassis.

BRIEF DESCRIPTION OF THE ACCOMPANYING DRAWINGS

The invention will be better understood on reading the appended figures, which are provided by way of example and in a non-limiting manner, in which.

DETAILED DESCRIPTION OF THE PREFERRED EMBODIMENTS

Figure 1:
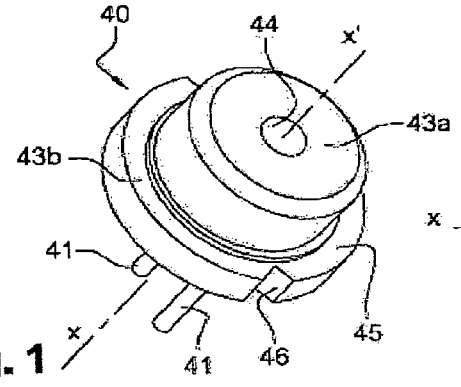
FIGS. 1 and 2 are perspective views of the front and rear face of a laser diode.
Figure 2:
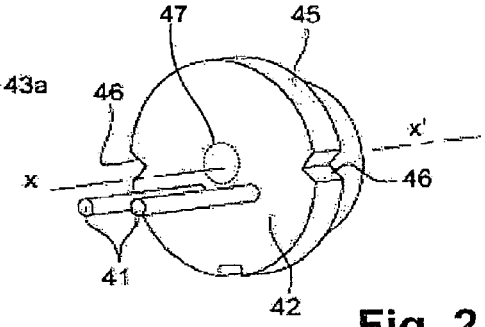

The diode 40, preferably a high-power laser diode, shown in FIGS. 1 and 2, comprises a part oriented forward that may comprise one or more front faces 43*a*, 43*b* offset laterally relative to one another, and a rear face 42. Connection pins 41 emerge from the rear face 42. Although two in number in this case, the number of connection pins 41 is non-limiting. The diode 40 comprises a central axis xx' substantially perpendicular to the front face 43*a* and rear face 42 and passing through a light emission zone 44 of the light proper, which constitutes the hottest spot of the diode 40. The amount of heat generated by the light emission zone 44 is thus at its maximum at the central axis xx'.

There is an imaginary disk or an area of the light emitting diode or zone 47, shown in dots in FIG. 2, centered on the central axis xx' of the diode 40 and having no intersection with the connection pins 41. It will also be seen that the central axis xx' does not consist of an axis of symmetry for the connection pins 41, which are thus slightly off center relative to this central axis xx'.

This type of "high-power" diode 40 emitting light at a wavelength in a range from 350 nm to 850 nm, preferably 445 nm, consumes an electrical power that may range from 5 mW to 10 W. It is also possible to use laser diodes emitting in the ultraviolet, blue, green, red or infrared spectrum.

The diode 40 comprises a lateral edge 45, in the form of a collar in this case, in which are formed two notches 46, the use of which will be described in detail below.

Figure 3A:
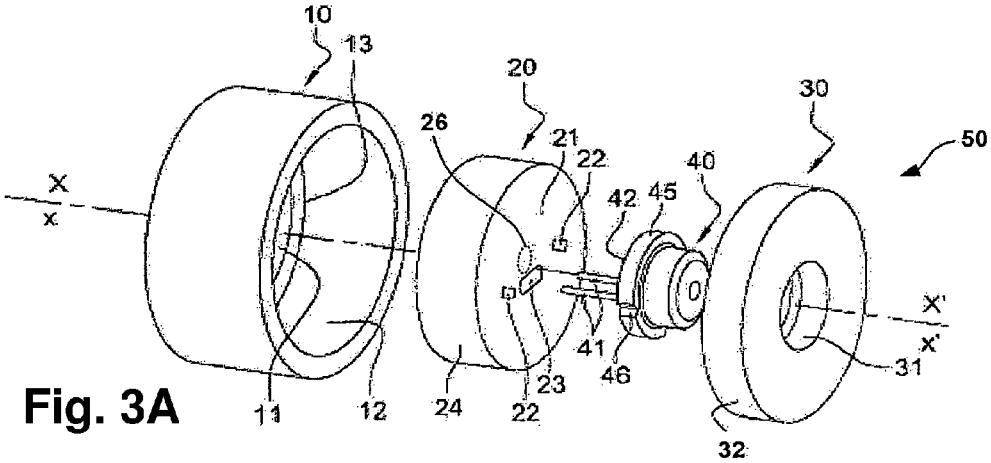
FIG. 3A is a perspective view of the lighting module according to the invention.

FIG. 3A illustrates a light device 50 according to the invention, formed by the assembly of a heatsink 20, a casing 10 and a positioning disk or closure element 30.

The heatsink 20 comprises a body 24 of which the front face 21 constitutes the abutment face against which the rear face 42 of the diode 40 is maintained. An orifice 23 passes through the body 24 of the heatsink 20 so as to receive the connection pins 41, which extend, therefore, through the body 24. The connection pins 41 are connected to an electrical power source (not shown) by means of a connector (not shown) to which they gain access via the rear part of the heatsink 20.

FIG. 3A, which serves as the basis for the present description, illustrates a case in which the two connection pins 41 pass through the same orifice 23 that, preferably, has a substantially oblong form in these circumstances.

Figure 3B:
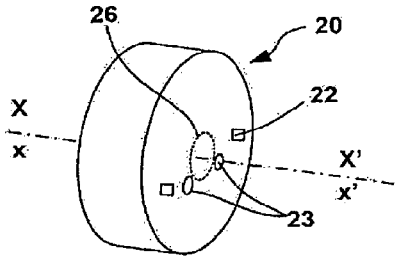
FIG. 3B is a variant embodiment of the body of the heatsink.

However, this embodiment is non-limiting, and it is quite possible to envisage providing as many orifices 23 as there are connection pins 41 in order to increase the contact surface between the rear face 42 of the diode 40 and the front face 21 of the body 24 of the heatsink 20, with a view to promoting heat exchanges between these two elements, as illustrated in FIG. 3B, in which the orifices 23 have a substantially circular form.

The front face 21 of the heatsink 20 also comprises two studs 22 arranged so as to be inserted in the notches 46 formed on the edge 45 of the diode 40. These studs 22 are designed to allow precise positioning of the diode 40 on the front face 21 of the body 24 of the heatsink 20 and to block rotation, about its central axis xx', of the diode 40 relative to the body 24 of the heatsink 20.

Figure 7:
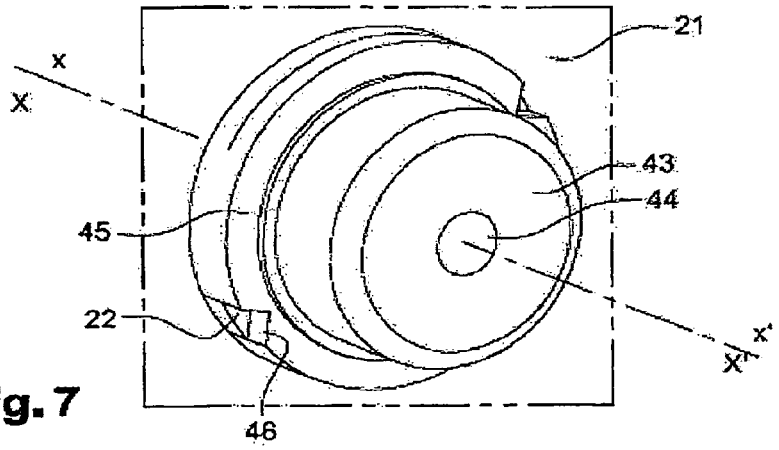
FIG. 7 is a detailed view of the front face of the body of the heatsink on which a laser diode is mounted in abutment.

FIG. 7 makes it possible to illustrate in greater detail the positioning of the studs 22 relative to the notches 46 when the rear face 42 of the diode 40 is in abutment against the front face 21 of the heatsink 20.

The lighting module according to the invention also comprises a casing 10 in which the heatsink 20 is inserted. The heatsink 20 is in abutment against the end wall 13 of the casing 10. Preferably, the casing 10 and the heatsink 20 are of complementary form.

The angular position of the heatsink 20 relative to the casing 10 can be adjusted about an axis XX'. This axis XX' of rotation is substantially perpendicular to the front face 21 of the body 24 of the heatsink 20.

By positioning the orifices 23 and the studs 22 appropriately, the central axis xx' of the diode 40 can be made to coincide with the axis XX' of rotation of the heatsink 20 in the casing 10 when the diode 40 is in abutment against the front face 21 of the body 24 of the heatsink 20 and the studs 22 are inserted in the notches 46.

Thus, the rotation of the heatsink 20 through a given angular value about the axis XX' gives rise to a rotation of the diode 40 of the same angular value about its central axis xx'.

As may be seen in FIG. 3A, the orifice 23 is also arranged such that, once the diode 40 has been mounted on the heatsink 20, the central axis xx' of the diode 40 does not pass through the orifice 23. There is thus, on the front face 21 of the heatsink 20, an imaginary disk or an area of a surface of the light emitting diode or zone 26, also represented in dots, centered on the axis xx', which is one and the same as the axis XX', on which the imaginary disk or zone 47 of the diode 40 is in abutment, so as to promote heat exchanges between the central part of the diode 40 corresponding to the hottest zone and the heatsink 20.

It will be noted that a similar arrangement may also be achieved when the connection pins 41 are arranged substantially symmetrically on a circle centered on the central axis xx' or, in the case of two connection pins 41, on a circle centered on the middle of the segment passing through the bases of the connection pins 41. It suffices, in fact, to form, in the heatsink 20, as many orifices 23 as there are connection pins 41, each of the orifices 23 of substantially circular cross section thus having a small diameter so that only a single connection pin 41 is allowed through, as illustrated in FIG. 3B. The device according to the invention therefore allows the rotation of the heatsink 20 on which the diode 40 is mounted in the casing 10, about its axis XX', corresponding to the central axis xx' of the diode 40, in order to adjust the illumination device in which the lighting module is inserted while achieving optimal evacuation of the heat produced by the diode 40.

The lighting module according to the invention thus makes it possible to place a zone 47 of the rear face 42 of the diode 40, centered about the hot spot and the central axis xx', in contact with the imaginary disk or an area of a surface of the light emitting diode or zone 26 of the front face 24 of the heatsink 20, irrespective of the type of diode 40 employed.

A window 11 is formed in the wall 13 forming the end wall of the casing 10 in order to allow the passage of the connection wires.

A closure element 30 is associated with the casing 10, to which it is mechanically linked. This closure element 30 is designed, by enclosing the heatsink 20 and the diode 40 inside the casing 10, to maintain the diode 40 in abutment against the front face 21 of the heatsink 20. An opening 31 is formed in the center of the closure element 30 to allow the passage of the rays of light emitted by the light emission zone 44. The closure element 30 bears on the edge 45 of the diode 40.

Figure 4:
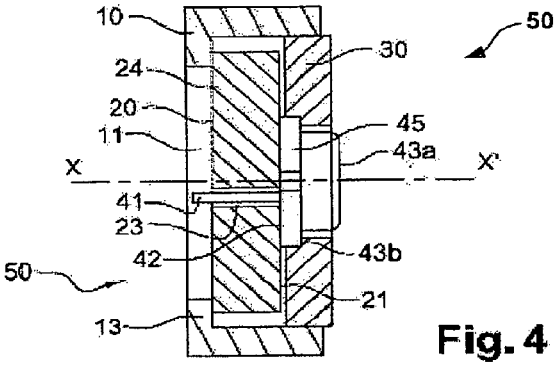
FIG. 4 is a sectional view of the lighting module in which a laser diode is mounted.

In the case illustrated in FIGS. 3A and 4, threads arranged, respectively, on the interior lateral face 12 of the casing 10 and on the lateral face 32 of the closure element 30 make it possible to establish a mechanical link of screw/nut type between the closure element 30 and the casing 10. However, the method of the mechanical link between the closure element 30 and the casing 10 is non-limiting and may also be achieved, by way of example, with the aid of clip or snap-fit means.

When the lighting module 50 has been assembled, the closure element 30 presses the rear face 42 of the diode 40 against the front face 21 of the heatsink 20, and the rear face of the body 24 of the heatsink 20 abuts against the end wall 13 of the casing 10, such that the diode 40 is held in a specific, fixed angular position inside the casing 10.

As illustrated in FIGS. 3A to 6, the closure element 30 may be a separate component. When it constitutes a complementary component of the casing 10. It may also constitute a joining component optionally forming part of the chassis of an illumination device and allowing the fastening of the casing 10 on the chassis.

In order to adjust the angular position of the diode 40 about its axis xx', it suffices to slightly unscrew the casing relative to the closure element 30 and to cause the heatsink 20 to turn about the axis XX', aligned with the central axis xx' of the diode 40, in order to cause the diode 40 to undergo a rotation of the same angular value about its axis xx'. The studs 22 prevent the diode 40 from rotating at all relative to the body 24 of the heatsink 20. When the angular position of the diode 40 is deemed to be satisfactory, the casing 10 is screwed back into the closure element 30 in such a manner as to place the diode 40 and the heatsink 20 back in axial pressure and to prevent the movement of the heatsink 20 and of the diode 40 inside the casing 10.

FIG. 4 illustrates an assembled lighting module 50, in accordance with a side sectional view and comprising a diode 40 mounted on the body 24 of a heatsink 20, these being arranged in a casing 10 closed by a closure element 30.

It will be observed that the orifice 23 is sufficiently offset relative to the central axis xx' of the diode 40 to allow contact between the hotspot of the diode 40 and the front face 21 of the heatsink 20. This contact makes it possible to promote the flow of heat from this rear central part toward the heat sink 20 constituted by the dissipater.

Figure 5:
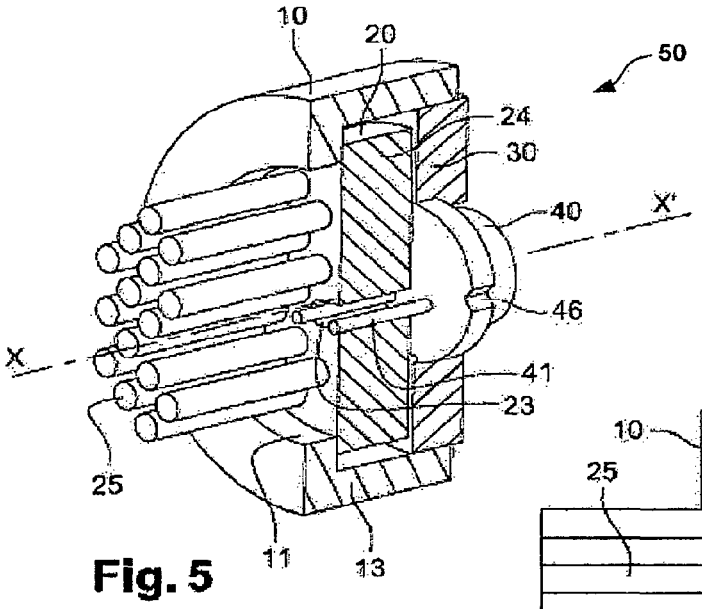
FIG. 5 is a perspective view of a lighting module according to an alternative embodiment in which a laser diode is mounted.
Figure 6:
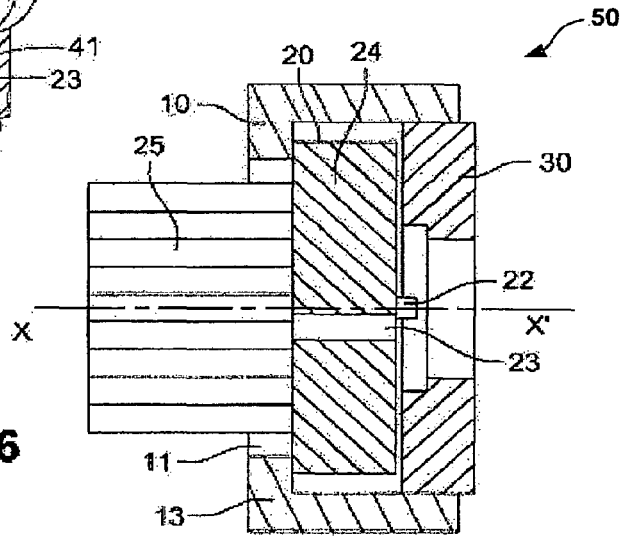
FIG. 6 is a sectional view of the lighting module according to this alternative.

FIGS. 5 and 6 illustrates a variant embodiment of the heatsink 20, the body 24 of which carries exchange elements 25 extending axially in the rear part of the body 24 and passing via the opening 11 in the end wall 13 of the casing 10.

The embodiments of the heatsink 20 that are shown to support the present description are non-limiting, and the lighting module according to the invention may have a heatsink 20 comprising air circulation means, means for the circulation of a cooling liquid or of a heat-transfer fluid allowing evacuation of the heat toward an external cold source, or a heatsink 20 comprising a thermoelectric system based on physical principles known by the name of the Peltier effect.

Figure 8:
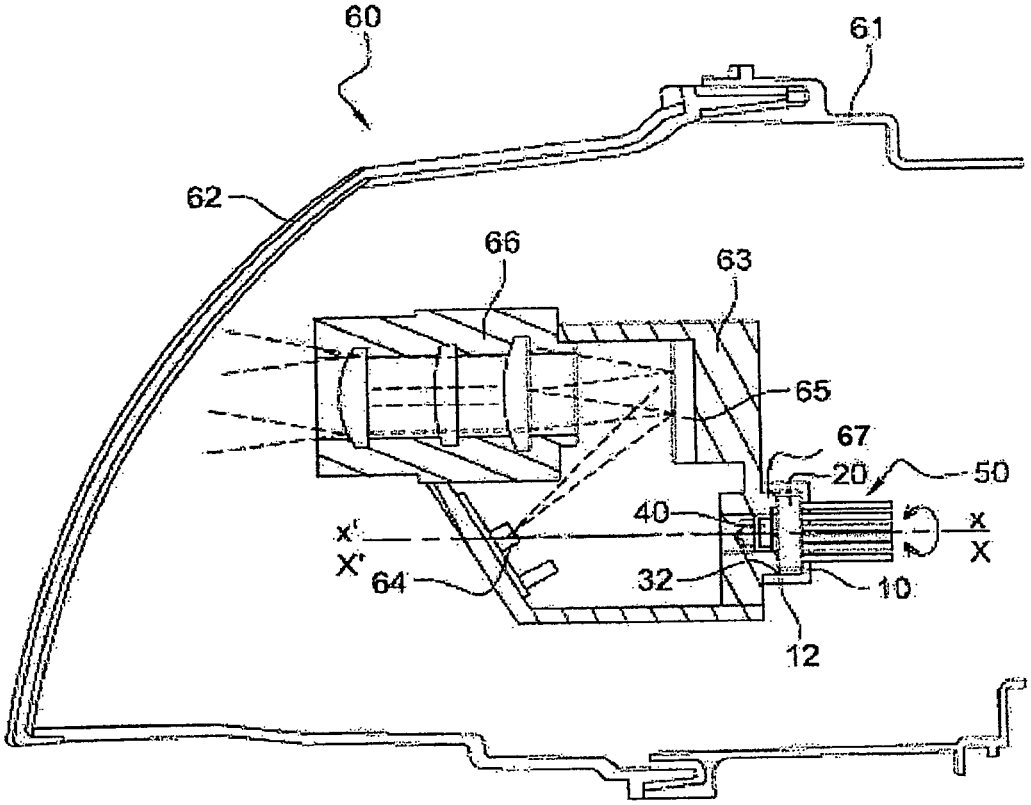
FIG. 8 is a schematic view of an illumination device comprising a light source and a lighting module according to the invention.

FIG. 8 shows an illumination device 60 comprising a lighting module 50 according to the invention.

The illumination device 60 comprises a casing 61 on which a lens 62 is mounted. The casing 61 also comprises an optical device of the type described in publication EP 2 690 352, which is equivalent to U.S. Patent Publication 2014/0029282, already cited as reference, and of which the lighting module 50 constitutes the primary light source. An optical imaging system 66, a wavelength conversion device 65, a scanning device 64 and the lighting module 50 are mounted on a chassis 63 supporting the casing 61 also.

The radiation issuing from the light source of the diode 40 is directed toward the scanning device 64, which distributes the light beam on the wavelength conversion device 65. The light re-emitted by the wavelength conversion device 65 is directed on the optical imaging system 66, which projects the light beam to the front of the illumination device 60, passing through the lens 62.

The lighting module 50 comprises a high-power laser diode 40 mounted in abutment against the heatsink 20 inserted in the casing 10.

In this case, the closure element 30 is formed by a boss 67 forming part of the chassis 63 and on which the casing 10 is screwed.

The angular position of the laser diode 40 about its axis xx', which is one and the same as the axis XX' of rotation of the heatsink 20 in the casing 10, is adjusted quite simply by slightly unscrewing the casing 10 and by causing the heatsink 20 to turn until the optimal position has been achieved. Once adjustment has been completed, the casing 10 is screwed back into the boss 67 acting as closure element.

Although the invention is being described in respect of a laser diode 40, it applies equally well to a source of light comprising at least one semi-conductor emitting chip, preferably an electroluminescent diode.

The preferred embodiments of the invention that serve as basis for the present description are non-limiting and may be the subject of variants that make it possible to obtain the technical effects as described and claimed, or equivalent effects that will be clearly apparent to the person skilled in the art.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A lighting module for at least one of illumination or signaling, comprising a heatsink on which is mounted a light emitting diode comprising a central axis (xx'), said heatsink comprising a body of which a front face is maintained in abutment against a rear face of said light emitting diode, said body comprising at least one orifice passing through said body and opening out on its front face through which pass one or more connection pins extending from said rear face of said light emitting diode, wherein said central axis (xx') of said light emitting diode does not pass via said at least one orifice passing through said body and through which said one or more connection pins extend;

wherein said one or more connection pins are in direct physical contact with a surface of said light emitting diode;

wherein said one or more connection pins are offset from central axis (xx') of said light emitting diode.

2. The lighting module according to claim 1, wherein said rear face of said light emitting diode comprises an area of a surface of said light emitting diode, centered on said central axis (xx'), which is in contact with said front face of said body of said heatsink.

3. The lighting module according to claim 1, wherein said heatsink is mounted in a casing such that an angular position of said heatsink relative to said casing can be adjusted in rotation about an axis (XX') substantially perpendicular to said front face of said body of said heatsink.

4. The lighting module according to claim 3, wherein the axis (XX') of rotation of said heatsink in said casing and said central axis (xx') of said light emitting diode are one and the same.

5. The lighting module according to claim 3, wherein said axis (XX') of rotation of said heatsink does not pass via said at least one orifice formed in said body of said heatsink.

6. The lighting module according to claim 1, wherein said body of said heatsink comprises as many of said at least one orifice, each designed to receive a connection pin, as there are of said connection pin extending from said rear face of said light emitting diode.

7. The lighting module according to claim 1, wherein said body of said heatsink and said light emitting diode comprise means for blocking the rotation of said diode about said central axis (xx') relative to said body of said heatsink.

8. The lighting module according to claim 7, wherein said means for blocking the rotation of said diode are formed by studs arranged on said front face of said body of said heatsink collaborating with notches formed on lateral edges of said light emitting diode.

9. The lighting module according to claim 1, further comprising a closure element abutting on a front part of said diode in order to maintain said diode in abutment on said front face of said body of said heatsink.

10. The lighting module according to claim 9, wherein said closure element and a casing are mechanically linked to one another in such a manner as to prevent the exit of said heatsink from said casing.

11. The lighting module according to claim 10, wherein said closure element and said casing are mechanically linked to one another by a link of screw/nut type or by clip or snap-fit means.

12. The lighting module according to claim 1, wherein said light emitting diode is a laser diode.

13. A lighting device, in particular for at least one of illumination or signaling for a motor vehicle, comprising a lighting module according to claim 1, fastened to a chassis of said lighting device by means of a casing.

14. The lighting module according to claim 2, wherein said heatsink is mounted in a casing such that an angular position of said heatsink relative to said casing can be adjusted in rotation about an axis (XX') substantially perpendicular to said front face of said body of said heatsink.

15. The lighting module according to claim 4, wherein said axis (XX') of rotation of said heatsink does not pass via said at least one orifice formed in said body of said heatsink.

16. The lighting module according to claim 2, wherein said body of said heatsink comprises as many of said at least one orifice, each designed to receive a connection pin, said connection pin extending from said rear face of said light emitting diode.

17. The lighting module according to claim 2, wherein said body of said heatsink and said light emitting diode comprise means for blocking the rotation of said diode about said central axis (xx') relative to said body of said heatsink.

18. The lighting module according to claim 2, further comprising a closure element abutting on a front part of said diode in order to maintain said diode in abutment on said front face of said body of said heatsink.

19. The lighting module according to claim 2, wherein said light emitting diode is a laser diode.

20. A lighting module for at least one of illumination or signaling, comprising a heatsink on which is mounted a light emitting diode comprising a central axis (xx'), said heatsink comprising a body of which a front face is maintained in abutment against a rear face of said light emitting diode, said body comprising at least one orifice passing through said body and opening out on its front face through which pass one or more connection pins extending from said rear face of said light emitting diode, wherein said central axis (xx') of said light emitting diode does not pass via said at least one orifice passing through said body and through which said one or more connection pins extend;

wherein said lighting module comprises a closure element abutting on a front part of said diode in order to maintain said diode in abutment on said front face of said body of said heatsink;

wherein said closure element is formed by a boss forming part of a chassis.

* * * * *